US011812224B2

(12) United States Patent
Kuenzle et al.

(10) Patent No.: US 11,812,224 B2
(45) Date of Patent: Nov. 7, 2023

(54) HEARING DEVICE COMPRISING A DELAYLESS ADAPTIVE FILTER

(71) Applicant: Oticon A/S, Smørum (DK)

(72) Inventors: Bernhard Kuenzle, Düdingen (CH); Meng Guo, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/687,191

(22) Filed: Mar. 4, 2022

(65) Prior Publication Data

US 2022/0286790 A1 Sep. 8, 2022

(30) Foreign Application Priority Data

Mar. 5, 2021 (EP) ..... 21160951

(51) Int. Cl.
*H04R 25/00* (2006.01)

(52) U.S. Cl.
CPC ..... *H04R 25/505* (2013.01); *H04R 25/407* (2013.01); *H04R 25/453* (2013.01)

(58) Field of Classification Search
CPC ... H04R 25/407; H04R 25/453; H04R 25/505
See application file for complete search history.

(56) References Cited

U.S. PATENT DOCUMENTS 5,329,587 A 7/1994 Morgan et al.
2011/0249847 A1* 10/2011 Salvetti ..... H04R 25/453 381/318
2019/0132686 A1* 5/2019 Kuriger ..... H04R 25/505

OTHER PUBLICATIONS

European Search Report issued in priority application No. 21160951.6 dated Aug. 18, 2021.
Guldenschuh, "New Approaches for Active Noise Control Headphones", Institute of Electronic Music and Acoustics, University of Music and Performing Arts Graz, 2014, Total 108 pages.
Pradhan et al., "Two microphone acoustic feedback cancellation in digital hearing aids: A step size controlled frequency domain approach", Applied Acoustics, 2018, vol. 132, pp. 142-151.
Huo et al., "New Weight Transform Schemes for Delayless Subband Adaptive Filtering", Proc. IEEE Global Telecommunications Conf., vol. 1, Nov. 2001, pp. 197-201.
Morgan, et al., "A Delayless Subband Adaptive Filter Architecture", IEEE Transactions on Signal Processing, vol. 43, No. 8, Aug. 1995, pp. 1819-1830.

* cited by examiner

*Primary Examiner* — Suhan Ni
(74) *Attorney, Agent, or Firm* — Birch, Stewart, Kolasch & Birch, LLP

(57) ABSTRACT

A hearing device includes a feedback control system that applies an adaptive filtering algorithm. The adaptive algorithm provides a filter control signal to adaptively control filter coefficients based on first and second algorithm input signals of a forward path. The feedback control system further includes first and second transform units for transforming the first and second algorithm input signals to the transform domain, and an inverse transform unit to convert an estimate of the current feedback path in the transformed domain to a time domain estimate, and a combination unit in the forward path to subtract the estimate of the current feedback signal from a signal of the forward path to provide a feedback corrected signal.

20 Claims, 6 Drawing Sheets

HEARING DEVICE COMPRISING A DELAYLESS ADAPTIVE FILTER

TECHNICAL FIELD

Traditionally, time domain adaptive filters have been used in many practical applications such as acoustic feedback and echo cancellation. However, especially for feedback and echo cancellation systems with very long feedback and echo paths, the computational complexity becomes a problem for real applications. Hence, frequency domain adaptive filters have been invented to significantly reduce the computational complexity for these systems with long impulse responses. Moreover, it also provides frequency dependent control of the adaptive filters. However, in the traditional frequency domain adaptive filter approach, it unavoidably introduces an additional delay in the signal path (between microphone and loudspeaker) due to frame processing, which cannot be accepted in some applications. Thus, a new class of delayless adaptive filters have been proposed. In the present disclosure, a new structure of the delayless adaptive filter, which has an improved performance in terms of convergence and steady state behaviour compared to the existing delayless structure, is proposed.

SUMMARY

A Hearing Aid:

In an aspect of the present application, a hearing device, e.g. a hearing aid or a headset, adapted to be worn by a user, or for being partially implanted in the head of the user is provided. The hearing device comprises a forward path for processing an audio signal. The forward path comprises a) at least one input transducer for converting a sound to corresponding at least one electric input signal representing said sound, b) a hearing aid processor for providing a processed signal in dependence of said at least one electric input signal, or a signal originating there from, and c) an output transducer for providing stimuli perceivable as sound to the user in dependence of said processed signal. The hearing device further comprises a feedback control system. The feedback control system comprises an adaptive filter, and a combination unit. The adaptive filter comprises an adaptive algorithm unit and a time varying filter. The adaptive algorithm unit may be configured to provide a filter control signal for adaptively controlling filter coefficients of the time varying filter in dependence of different first and second algorithm input signals of the forward path. The adaptive algorithm unit may comprise A) first and second transform units for transforming said different first and second algorithm input signals to respective first and second transform domain algorithm input signals, B) an adaptive algorithm configured to provide an estimate in the transform domain of a current feedback path from the output transducer to the input transducer in dependence of said first and second transform domain algorithm input signals, and C) an inverse transform unit configured to convert the estimate of the current feedback path in the transform domain to an estimate of the current feedback path in the time domain. The filter control signal may be provided in dependence of said estimate of the current feedback path in the time domain. The time varying filter may be configured to use adaptive filter coefficients controlled in dependence of the filter control signal to provide an estimate of an impulse response of the current feedback path to thereby provide an estimate of a current feedback signal (v) in dependence of the processed signal. The combination unit may be located in the forward path and configured to subtract said estimate of the current feedback signal from a signal of the forward path to provide a feedback corrected signal. The first and second transform units and said inverse transform unit comprise respective linear convolution constraints. The time varying filter may be configured to operate in the time domain.

Thereby hearing device comprising an improved feedback control system may be provided.

The adaptive algorithm may be updated based on an unconstrained gradient determined from the first and second transform domain algorithm input signals ($\underline{E}$, $\underline{U}$) as $\underline{U}^*\odot\underline{E}$, where * denotes the complex conjugate, and $\odot$ denotes vector elementwise multiplication. Thereby a computationally power economic scheme is provided (which is advantageous in miniature portable devices such as hearing aids).

The first and second transform units and the inverse transform unit comprise respective linear convolution constraints to ensure that the transform (e.g. frequency) domain algorithm provides a resulting time domain filter $\underline{h}'(n)$ to perform the desired linear convolution. Each of the first and second transform units are configured to apply the linear convolution constraint to the first and second algorithm input signals and to apply a transform (e.g. Fourier) transform algorithm to the respective linearly constrained signals to thereby provide the first and second algorithm input signals in the transform (e.g. frequency) domain. The Fourier transform algorithm may comprise a Discrete Fourier Transform (DFT) algorithm, e.g. a Short Time Fourier Transform (STFT) algorithm (can also be facilitated by a DFT-filter bank and a STFT-filter bank, respectively). Other transforms than the Fourier transform may be used, however, e.g. cosine, wavelet, Laplace, etc.

The term 'an estimate of an impulse response' is intended to include the term 'an estimate of feedback path'.

The filter control signal may be equal to the estimate of the current feedback path in the time domain ($\underline{h}'$). The filter control signal may comprise update filter coefficients (or updates to filter coefficients) for use in the time varying filter providing the estimate of the current feedback path in the time domain ($\underline{h}'$).

The linear convolution constraint may be applied to respective first and second algorithm input signal vectors, each comprising a present value and a number of previous values of the respective first and second algorithm input signals. The number of previous values may be the last L−1 values. The number L may be equal to the order of the adaptive filter.

The respective first and/or second algorithm input signal vectors may contain a number of added time sample values. The added time sample values may e.g. be previous values of the signal, or constant values, e.g. zeros. The added time sample values may e.g. be previous values of the algorithm input vector in question.

The linear convolution constraint may further be applied to respective transformed first and second algorithm input signal vectors, each comprising a present value and a number of previous values of the respective first and second algorithm input signals, and/or a number of added time sample values. The linear convolution constraint applied to the transformed signal(s) may e.g. be additions, multiplications, sign flipping of transformed signal vector values.

The linear convolution constraint may be applied to the output from the inverse transform. The linear convolution constraint of the inverse transform is aimed at removing the values affected by circular convolution. The linear convolution constraint of the inverse transform may e.g. be implemented by discarding a part of the results, e.g. the second half of the resulting vector with L samples. The linear convolution constraint should ensure enough data to avoid circular convolution.

The linear convolution constraint may be implemented by using the overlap-save, and/or overlap-add techniques. The overlap-save technique is e.g. exemplified in the following linear convolution constraints of the algorithm input signal vectors $$\underline{e}(m)=[\underline{0}_L^T, e(m\cdot D-L+1), e(m\cdot D-L+2), \ldots, e(m\cdot D)]^T,$$

$$\underline{u}(m)=[u(m\cdot D-2L+1), u(m\cdot D-2L+2), \ldots, u(m\cdot D)]^T,$$

where $\underline{e}(m)$ and $\underline{u}(m)$ are (2L×1) first and second algorithm input signal vectors, where m=1, 2, . . . is the frame index, $\underline{0}_L$ is a null-vector containing L zeros, D is a decimation factor, L is the length of the adaptive filter $\underline{h}'(n)$, and the superscript T denotes the vector transpose. The elements of the (2L×1) signal vectors represent time domain samples of the input signals e and u to the adaptive algorithm.

The transform algorithm of the first and second transform units may thus be applied to first and second algorithm input signal vectors, respectively, each comprising more than L time samples, where L is the number of coefficients or weights controlling the adaptive filter $\underline{h}'(n)$.

The number of previous values of the respective first and second algorithm input signals is larger than or equal to L−1, e.g. larger than or equal to 2L−1. The appropriate number of previous values may depend on how the linear convolution constraint is implemented (overlap-save, overlap-add, etc.).

The linear convolution constraint of the first and second transform units may be different. The linear convolution constraint of the first transform unit applied to the first algorithm input signal may comprise a concatenation of a null vector (of dimension L, containing L zeros) and the current first algorithm input signal vector (of dimension L). The linear convolution constraint of the second transform unit applied to the second algorithm input signal may comprise a concatenation of a current (e.g. time index m) second algorithm input signal vector and previous (e.g. time index m−1) second algorithm input signal vector (both of dimension L). The resulting concatenated first and second algorithm input vectors are thus of dimension 2L.

The first algorithm input signal may comprise the feedback corrected signal. The second algorithm input signal may comprise the processed signal. The combination unit may be configured to subtract the estimate of the current feedback signal from the at least one electric input signal, or from a signal originating therefrom (e.g. a filtered (e.g. beamformed) version) to provide the feedback corrected signal.

The transform may be executed at a decimated rate D. The decimated rate D may e.g. be an integer larger than or equal to 1, e.g. 2 or 3, or e.g. a power of 2, or e.g. larger than 100, or e.g. larger than 1000.

The hearing device (e.g. the feedback control system, such as the adaptive algorithm unit) may comprise an interpolation function configured to provide the time variant filter works at a higher (e.g. non-decimated, e.g. full) sampling rate. The interpolation function may e.g. be applied to compensate for a decimated rate (D) used in the transform domain (e.g. to provide a transition from a time frame index m to a time sample index n). The interpolation function may be an interpolate and sample (or sample and interpolate) function to provide values in the interpolated (time domain) signal at the 'missing' instances. The interpolation (and sample) may be based on linear interpolation of more advanced interpolation functions, e.g. polynomial interpolation, etc. Instead, a simpler interpolation in the form of a sample and hold function may be applied.

The respective transform domain signal vectors $\underline{E}(m)$ and $\underline{U}(m)$ are computed as, $$\underline{E}(m)=\mathrm{TDA}(\underline{e}(m)),$$

$$\underline{U}(m)=\mathrm{TDA}(\underline{u}(m)),$$

where TDA is a Transform Domain Algorithm (e.g. a Fourier transform algorithm, a Laplace transform algorithm, a Z transform algorithm, a wavelet transform algorithm, etc.). The signals e(m), u(m) are the (adaptive) algorithm input signal vectors comprising the linear convolution constraint.

The transform domain may be the frequency domain (e.g. provided by a Fourier transform algorithm, e.g. a Discrete Fourier Transformation (DFT) algorithm).

The adaptive algorithm may comprise a complex Least Mean Square (LMS) or a complex Normalized Least Mean Square (NLMS) algorithm.

The hearing device may be constituted by or comprise an air-conduction type hearing aid, a bone-conduction type hearing aid, a cochlear implant type hearing aid, or a combination thereof.

The hearing aid may be adapted to provide a frequency dependent gain and/or a level dependent compression and/or a transposition (with or without frequency compression) of one or more frequency ranges to one or more other frequency ranges, e.g. to compensate for a hearing impairment of a user. The hearing aid may comprise a signal processor for enhancing the input signals and providing a processed output signal.

The hearing aid may comprise an output unit for providing a stimulus perceived by the user as an acoustic signal based on a processed electric signal. The output unit may comprise an output transducer. The output transducer may comprise a receiver (loudspeaker) for providing the stimulus as an acoustic signal to the user (e.g. in an acoustic (air conduction based) hearing aid). The output transducer may comprise a vibrator for providing the stimulus as mechanical vibration of a skull bone to the user (e.g. in a bone-attached or bone-anchored hearing aid).

The hearing aid may comprise an input unit for providing an electric input signal representing sound. The input unit may comprise an input transducer, e.g. a microphone, for converting an input sound to an electric input signal. The input unit may comprise a wireless receiver for receiving a wireless signal comprising or representing sound and for providing an electric input signal representing said sound. The wireless receiver may e.g. be configured to receive an electromagnetic signal in the radio frequency range (3 kHz to 300 GHz). The wireless receiver may e.g. be configured to receive an electromagnetic signal in a frequency range of light (e.g. infrared light 300 GHz to 430 THz, or visible light, e.g. 430 THz to 770 THz).

The hearing aid may comprise a directional microphone system adapted to spatially filter sounds from the environment, and thereby enhance a target acoustic source among a multitude of acoustic sources in the local environment of the user wearing the hearing aid. The directional system may be adapted to detect (such as adaptively detect) from which direction a particular part of the microphone signal originates. This can be achieved in various different ways as e.g. described in the prior art. In hearing aids, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing aid may comprise antenna and transceiver circuitry allowing a wireless link to an entertainment device (e.g. a TV-set), a communication device (e.g. a telephone), a wireless microphone, or another hearing aid, etc. The hearing aid may thus be configured to wirelessly receive a direct electric input signal from another device. Likewise, the hearing aid may be configured to wirelessly transmit a direct electric output signal to another device. The direct electric input or output signal may represent or comprise an audio signal and/or a control signal and/or an information signal.

In general, a wireless link established by antenna and transceiver circuitry of the hearing aid can be of any type. The wireless link may be a link based on near-field communication, e.g. an inductive link based on an inductive coupling between antenna coils of transmitter and receiver parts. The wireless link may be based on far-field, electromagnetic radiation. Preferably, frequencies used to establish a communication link between the hearing aid and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). The wireless link may be based on a standardized or proprietary technology. The wireless link may be based on Bluetooth technology (e.g. Bluetooth Low-Energy technology).

The hearing aid may be or form part of a portable (i.e. configured to be wearable) device, e.g. a device comprising a local energy source, e.g. a battery, e.g. a rechargeable battery. The hearing aid may e.g. be a low weight, easily wearable, device, e.g. having a total weight less than 100 g, such as less than 20 g.

The hearing aid may comprise a 'forward' (or 'signal') path for processing an audio signal between an input and an output of the hearing aid. A signal processor may be located in the forward path. The signal processor may be adapted to provide a frequency dependent gain according to a user's particular needs (e.g. hearing impairment). The hearing aid may comprise an 'analysis' path comprising functional components for analyzing signals and/or controlling processing of the forward path. Some or all signal processing of the analysis path and/or the forward path may be conducted in the frequency domain, in which case the hearing aid comprises appropriate analysis and synthesis filter banks. Some or all signal processing of the analysis path and/or the forward path may be conducted in the time domain.

An analogue electric signal representing an acoustic signal may be converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 s, for $f_s$=20 kHz. A number of audio samples may be arranged in a time frame. A time frame may comprise 64 or 128 audio data samples. Other frame lengths may be used depending on the practical application.

The hearing aid may comprise an analogue-to-digital (AD) converter to digitize an analogue input (e.g. from an input transducer, such as a microphone) with a predefined sampling rate, e.g. 20 kHz. The hearing aids may comprise a digital-to-analogue (DA) converter to convert a digital signal to an analogue output signal, e.g. for being presented to a user via an output transducer.

The hearing aid, e.g. the input unit, and or the antenna and transceiver circuitry The hearing aid, e.g. the input unit, and or the antenna and transceiver circuitry, may comprise a transform unit for converting a time domain signal to a signal in the transform domain (e.g. frequency domain, Laplace domain, Z transform, wavelet transform, etc.). The hearing aid may comprise a TF-conversion unit for providing a time-frequency representation of an input signal. The time-frequency representation may comprise an array or map of corresponding complex or real values of the signal in question in a particular time and frequency range. The TF conversion unit may comprise a filter bank for filtering a (time varying) input signal and providing a number of (time varying) output signals each comprising a distinct frequency range of the input signal. The TF conversion unit may comprise a Fourier transformation unit for converting a time variant input signal to a (time variant) signal in the (time-) frequency domain. The frequency range considered by the hearing aid from a minimum frequency $f_{mm}$ to a maximum frequency $f_{max}$ may comprise a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{ma}$. A signal of the forward and/or analysis path of the hearing aid may be split into a number NI of frequency bands (e.g. of uniform width), where NI is e.g. larger than 5, such as larger than 10, such as larger than 50, such as larger than 100, such as larger than 500, at least some of which are processed individually. The hearing aid may be adapted to process a signal of the forward and/or analysis path in a number NP of different frequency channels (NP≤NI). The frequency channels may be uniform or non-uniform in width (e.g. increasing in width with frequency), overlapping or non-overlapping.

The hearing aid may be configured to operate in different modes, e.g. a normal mode and one or more specific modes, e.g. selectable by a user, or automatically selectable. A mode of operation may be optimized to a specific acoustic situation or environment. A mode of operation may include a low-power mode, where functionality of the hearing aid is reduced (e.g. to save power), e.g. to disable wireless communication, and/or to disable specific features of the hearing aid.

The hearing aid may comprise a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing aid, a remote control, and audio delivery device, a telephone (e.g. a smartphone), an external sensor, etc.

One or more of the number of detectors may operate on the full band signal (time domain). One or more of the number of detectors may operate on band split signals ((time-) frequency domain), e.g. in a limited number of frequency bands.

The number of detectors may comprise a level detector for estimating a current level of a signal of the forward path. The detector may be configured to decide whether the current level of a signal of the forward path is above or below a given (L-)threshold value. The level detector operates on the full band signal (time domain). The level detector operates on band split signals ((time-) frequency domain).

The hearing aid may comprise a voice activity detector (VAD) for estimating whether or not (or with what probability) an input signal comprises a voice signal (at a given point in time). A voice signal may in the present context be taken to include a speech signal from a human being. It may also include other forms of utterances generated by the human speech system (e.g. singing). The voice activity detector unit may be adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). The voice activity detector may be adapted to detect as a VOICE also the user's own voice. Alternatively, the voice activity detector may be adapted to exclude a user's own voice from the detection of a VOICE.

The hearing aid may comprise an own voice detector for estimating whether or not (or with what probability) a given input sound (e.g. a voice, e.g. speech) originates from the voice of the user of the system. A microphone system of the hearing aid may be adapted to be able to differentiate between a user's own voice and another person's voice and possibly from NON-voice sounds.

The number of detectors may comprise a movement detector, e.g. an acceleration sensor. The movement detector may be configured to detect movement of the user's facial muscles and/or bones, e.g. due to speech or chewing (e.g. jaw movement) and to provide a detector signal indicative thereof.

The hearing aid may comprise a classification unit configured to classify the current situation based on input signals from (at least some of) the detectors, and possibly other inputs as well. In the present context 'a current situation' may be taken to be defined by one or more of a) the physical environment (e.g. including the current electromagnetic environment, e.g. the occurrence of electromagnetic signals (e.g. comprising audio and/or control signals) intended or not intended for reception by the hearing aid, or other properties of the current environment than acoustic);
b) the current acoustic situation (input level, feedback, etc.), and
c) the current mode or state of the user (movement, temperature, cognitive load, etc.);
d) the current mode or state of the hearing aid (program selected, time elapsed since last user interaction, etc.) and/or of another device in communication with the hearing aid.

The classification unit may be based on or comprise a neural network, e.g. a trained neural network.

The hearing aid may comprise an acoustic (and/or mechanical) feedback control (e.g. suppression) or echo-cancelling system. Adaptive feedback cancellation has the ability to track feedback path changes over time. It is typically based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

The hearing aid may further comprise other relevant functionality for the application in question, e.g. compression, noise reduction, etc.

The hearing aid may comprise a hearing instrument, e.g. a hearing instrument adapted for being located at the ear or fully or partially in the ear canal of a user, e.g. a headset, an earphone, an ear protection device or a combination thereof. The hearing assistance system may comprise a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing device, e.g. a hearing aid, as described above, in the 'detailed description of embodiments' and in the claims, is moreover provided. Use may be provided in a system comprising one or more hearing aids (e.g. hearing instruments), headsets, ear phones, active ear protection systems, etc., e.g. in handsfree telephone systems, teleconferencing systems (e.g. including a speakerphone), public address systems, karaoke systems, classroom amplification systems, etc.

A Method:

In an aspect, a method of operating a hearing device, e.g. a hearing aid or a headset, adapted to be worn by a user, or for being partially implanted in the head of the user, is provided. The hearing device comprises a forward path for processing an audio signal. The forward path comprises at least one input transducer for converting a sound to corresponding at least one electric input signal representing said sound, a hearing aid processor for providing a processed signal in dependence of said at least one electric input signal, and an output transducer for providing stimuli perceivable as sound to the user in dependence of said processed signal.

The hearing device further comprises a feedback control system comprising an adaptive filter comprising an adaptive algorithm and a time domain time varying filter.

The method comprises transforming different first and second algorithm input signals of the forward path to respective first and second transform domain algorithm input signals, configuring the adaptive algorithm to provide an estimate in the transform domain of a current feedback path from the output transducer to the input transducer in dependence of said first and second transform domain algorithm input signals, inversely transforming said estimate of the current feedback path in the transform domain to an estimate of the current feedback path in the time domain, providing a filter control signal in dependence of said estimate of the current feedback path in the time domain, adaptively controlling filter coefficients of the time varying filter in dependence of said filter control signal to thereby provide an estimate of a current feedback signal from said output transducer to said input transducer in dependence of the processed signal, and subtracting said estimate of the current feedback signal from a signal of the forward path to provide a feedback corrected signal.

The method may comprise that the transforming and the inversely transforming procedures comprise respective linear convolution constraints.

The adaptive algorithm may be updated based on an unconstrained gradient determined from the first and second transform domain algorithm input signals ($\underline{E}$, $\underline{U}$) as $\underline{U}^*\odot\underline{E}$, where * denotes the complex conjugate, and $\odot$ denotes vector elementwise multiplication.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium or Data Carrier:

In an aspect, a tangible computer-readable medium (a data carrier) storing a computer program comprising program code means (instructions) for causing a data processing system (a computer) to perform (carry out) at least some (such as a majority or all) of the (steps of the) method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Other storage media include storage in DNA (e.g. in synthesized DNA strands). Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application A Hearing System:

In a further aspect, a hearing system comprising a hearing aid as described above, in the 'detailed description of embodiments', and in the claims, AND an auxiliary device is moreover provided.

The hearing system may be adapted to establish a communication link between the hearing aid and the auxiliary device to provide that information (e.g. control and status signals, possibly audio signals) can be exchanged or forwarded from one to the other.

The auxiliary device may comprise a remote control, a smartphone, or other portable or wearable electronic device, such as a smartwatch or the like.

The auxiliary device may be constituted by or comprise a remote control for controlling functionality and operation of the hearing aid(s). The function of a remote control may be implemented in a smartphone, the smartphone possibly running an APP allowing to control the functionality of the audio processing device via the smartphone (the hearing aid(s) comprising an appropriate wireless interface to the smartphone, e.g. based on Bluetooth or some other standardized or proprietary scheme).

The auxiliary device may be constituted by or comprise an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

The auxiliary device may be constituted by or comprise another hearing aid. The hearing system may comprise two hearing aids adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device (e.g. a hearing aid) or a hearing system (e.g. a hearing aid system) described above in the 'detailed description of embodiments', and in the claims. The APP may be configured to run on cellular phone, e.g. a smartphone, or on another portable device allowing communication with said hearing aid or said hearing system.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, particularly to feedback estimation. In the present disclosure, a new structure of the so-called 'delayless adaptive filter' is proposed.

Figure 1A:
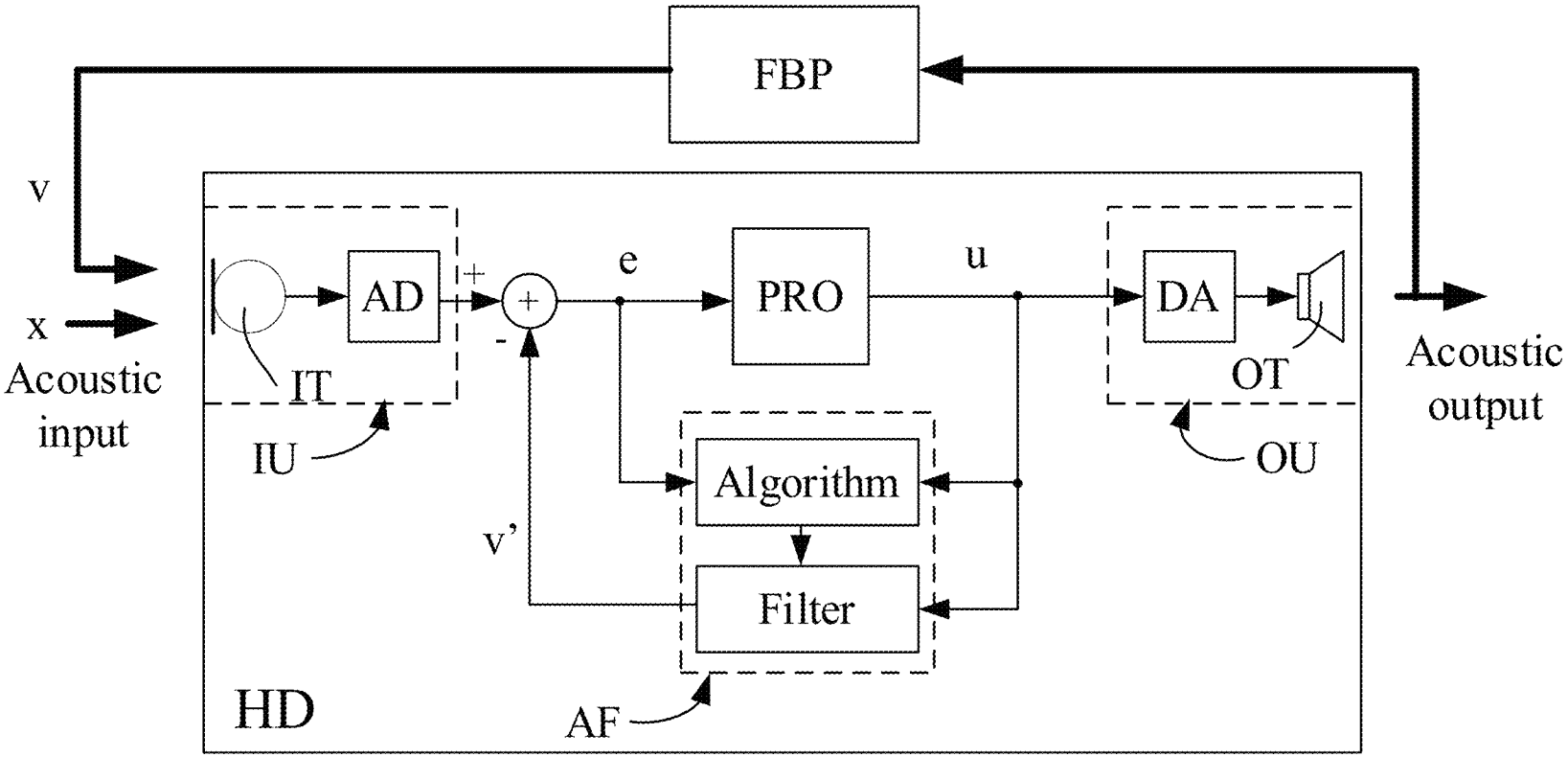
FIG. 1A shows a hearing device comprising an adaptive feedback cancellation setup according to the prior art comprising an adaptive filter.

FIG. 1A shows a hearing aid (HD) comprising an adaptive feedback cancellation system (comprising an adaptive filter (AF) and a combination unit ('+')) according to the prior art.

FIG. 1A shows some of the functional blocks of a hearing aid (HD), comprising a forward path (units IU, '+', PRO and OU) and an (unintentional) acoustical feedback path (FBP) of a hearing aid. In the present embodiment, the forward path comprises an input unit (IU) comprising an input transducer (IT), here a microphone (or a multitude of microphones), for receiving an external acoustic input from the environment ('Acoustic input' in FIG. 1A) and providing an electric input signal representative thereof, and an AD-converter for converting an analogue input signal from the microphone to a digitized signal representing the acoustic input (sound). The forward path further comprises combination unit '+' for subtracting an estimate of the feedback signal and providing a feedback corrected signal (e), and a hearing aid processor (PRO) for adapting the signal to the needs of a wearer of the hearing aid (e.g. applying an algorithm for compensating for a hearing impairment of the user) and providing a processed signal (u). The forward path further comprises an output unit (OU), optionally comprising a DA-converter for converting a digitized signal (here u) to an analogue signal and comprising an output transducer (OT), here a loudspeaker, for generating an acoustic output ('Acoustic output' in FIG. 1A) representative of sound to a wearer of the hearing aid. The intentional forward or signal path and components of the hearing aid are enclosed by the dotted outline. An (external, unintentional) acoustical feedback path (FBP) from the output of the output transducer (OT) to the input of the input transducer (IT) is indicated. The acoustic input signal to the input transducer (IT, microphone) is a sum of an acoustic feedback signal (v) propagated via the acoustic feedback path (FBP) and an external acoustic input signal (x). The external acoustic input signal may include background or ambient noise as well 'target sounds', e.g. speech from one or more persons. The hearing aid additionally comprises an electrical feedback cancellation path (comprising units AF and '+') for reducing or cancelling acoustic feedback from the 'external' feedback path' (FBP) of the hearing aid. The 'external' acoustic feedback path here includes microphone (IT) and AD-converter (AD) and DA-converter (DA) and loudspeaker (OT) and possible other components included in the input and output units (IU, OU, e.g. a filter bank or respective Discrete Fourier Transformation (DFT) and Inverse DFT (IDFT) algorithms, or similar), respectively). Here, the electrical feedback cancellation path comprises an adaptive filter (AF), which is controlled by a prediction error algorithm (Algorithm), e.g. a Least Mean Square (LMS) or Normalized LMS (NLMS) algorithms, or similar algorithm, in order to predict and cancel the part of the microphone signal that is caused by feedback from the loudspeaker to the microphone of the hearing aid.

The adaptive filter (AF) comprises a 'Filter' part (Filter) and a prediction error algorithm part (Algorithm) is aimed at providing a good estimate (v') of the 'external feedback path' from the input of the output unit (here the DA) to the output from input unit (here the AD). The prediction error algorithm uses a reference signal (u) together with the (feedback corrected) microphone signal (e) to find the setting (coefficients) of the adaptive filter that minimizes the prediction error when the reference signal (u) is applied to (filtered by) the adaptive filter. The forward path of the hearing aid comprises signal processor (PRO) to adjust the signal to the (possibly impaired) hearing of the user. In the embodiment of FIG. 1A, the processed output signal (u)

from the hearing aid signal processor (PRO) is used as the reference signal, which is fed to (the Algorithm and Filter parts of) the adaptive filter (AF).

Figure 1B:
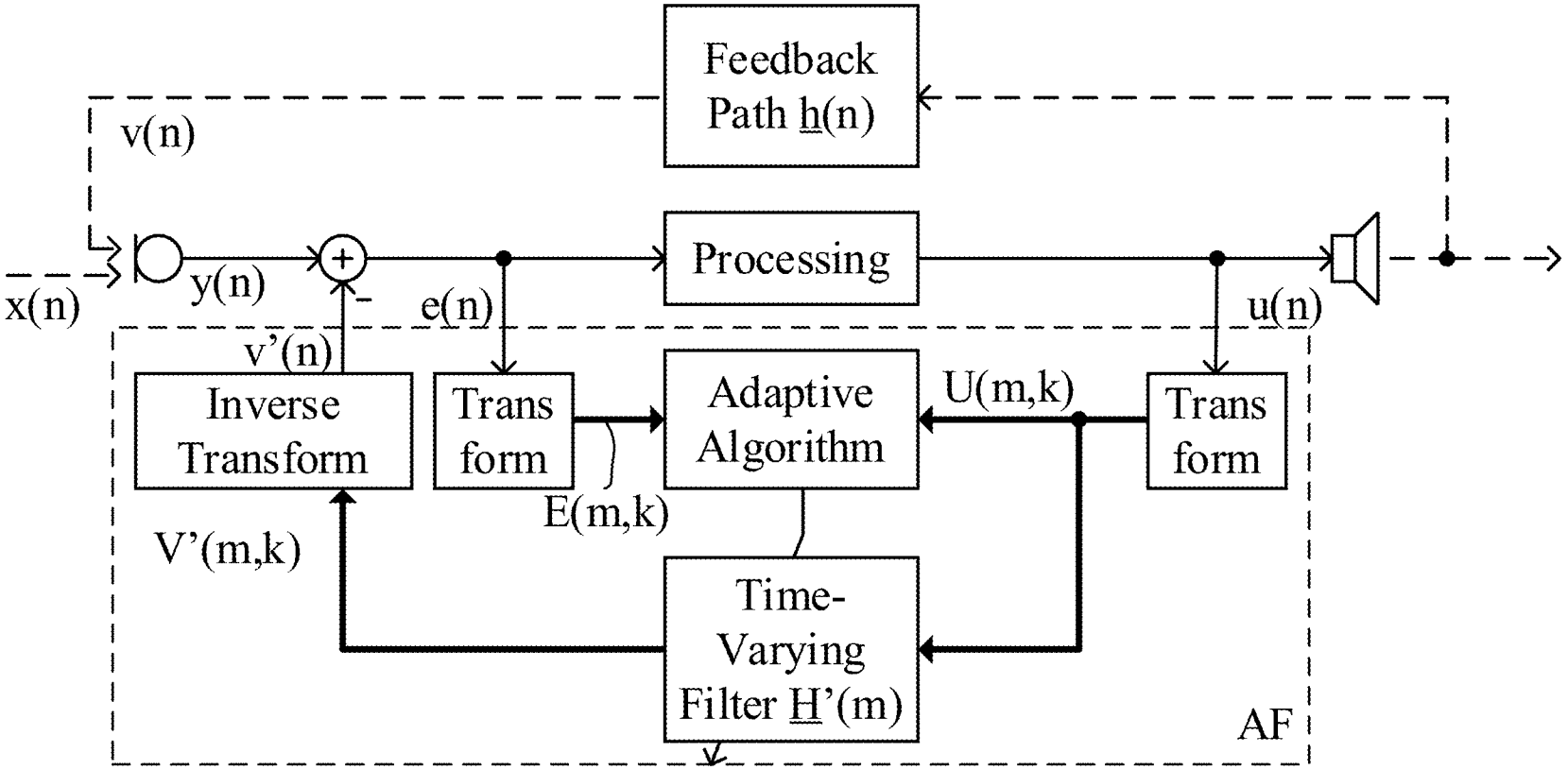
FIG. 1B shows a hearing device comprising an adaptive feedback cancellation setup according to the prior art using a frequency domain adaptive filter.
Figure 2:
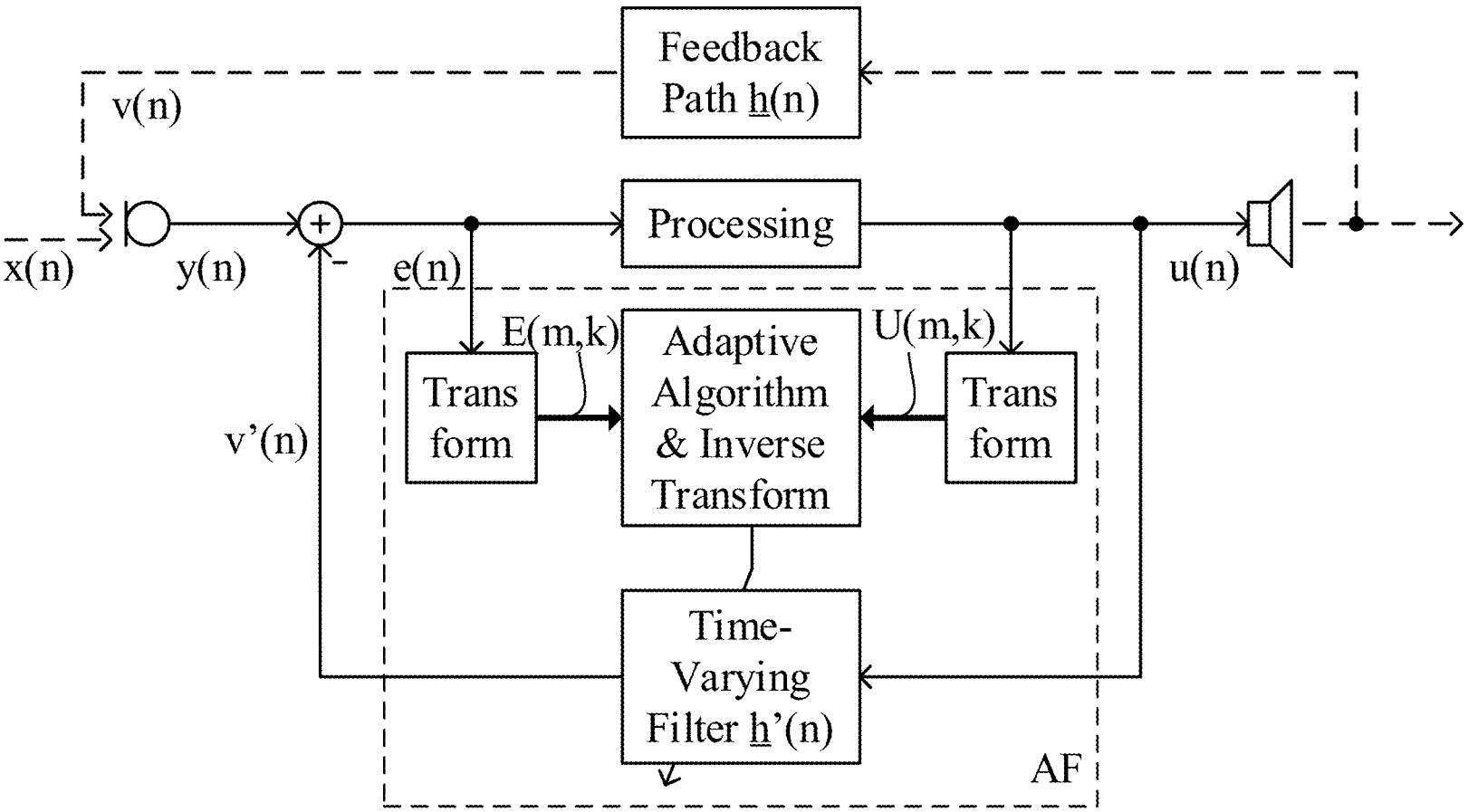
FIG. 2 shows a hearing device comprising an exemplary delayless structure of an adaptive feedback cancellation setup according to the prior art.

Some or all of the signals of the embodiment of FIG. 1A may be dependent on the frequency (cf. e.g. FIG. 1B, 2, 3. In practice this implies the existence of time to frequency conversion and frequency to time conversion units (e.g. in connection with the input and output transducers (e.g. forming part of respective input and output units (IU and OU, respectively)). Such conversion units may be implemented in any convenient way, including filter banks, or Fourier Transformation (FT) algorithms, e.g. Discrete FT (DFT), Fast FT (FFT), Short Time FT (STFT), etc., time-frequency mapping, etc. The processor (PRO, in FIG. 1A or Processing in FIGS. 1B, 2) may e.g. comprise a filter bank or a Fourier transformation algorithm, as appropriate, to allow processing to be carried out in the frequency domain (e.g. in frequency sub-bands).

FIG. 1B shows an embodiment of a hearing device comprising an adaptive feedback cancellation setup according to the prior art using a frequency domain adaptive filter. The embodiment of FIG. 1B is similar to the embodiment of FIG. 1A apart from the specific function of the adaptive filter being carried out in a transform domain (e.g. the frequency domain). The feedback path is denoted 'Feedback path $\underline{h}(n)$' indicating time variant feedback transfer function or impulse response $\underline{h}(n)$. The feedback cancellation system of FIG. 1B comprises a traditional frequency domain adaptive filter (FDAF), where all inputs to and outs from the adaptive filter are in the transform domain (here frequency domain). The forward path processor (termed 'Processing n FIG. 1B, 2, 3) may work in the time domain or in the frequency domain. Signal processing before and after the processor is e.g. carried out in the time domain, as indicated by time index 'n'. The feedback corrected signal e(n) and the processed signal u(n) are converted to the transform domain by respective blocks (Transform), e.g. comprising a Fourier transform algorithm, providing transform domain signals E(m,k) and U(m,k), respectively, where m is a time frame index and k may be a frequency index. The adaptive algorithm provides update filter coefficients to the filter part of the adaptive filter (denoted 'Time-Varying Filter $\underline{H}'(m)$' in FIG. 1B). The filter part of the adaptive filter thereby provides an estimate of a transfer function $\underline{H}'$ of the current feedback path $\underline{h}$, and thus provides an estimate V'(m,k) of the feedback signal v(n) when the processed signal U(m,k) is filtered by the adaptive filter. The estimate V'(m,k) of the feedback signal v(n) is fed to the 'Inverse Transform' block comprising an inverse transform algorithm (e.g. an inverse Fourier transform algorithm (IFT)) to thereby provide the estimate v'(n) of the feedback signal in the time domain. The time domain estimate v'(n) of the feedback signal is subtracted from the electric input signal y(n) (e.g. digitized) from the microphone in subtraction unit '+' thereby providing feedback corrected (error) signal e(n) which is fed to the transform block (Transform) and to the processor (Processing) providing processed signal u(n) in the time domain.

The state-of-the-art delayless structure is originally described in [1, 2] and patented in [3] is illustrated in FIG. 2. FIG. 2 shows an exemplary delayless structure of an adaptive feedback cancellation setup according to the present disclosure. The main idea is to estimate the adaptive filter in the frequency domain but to perform the cancellation in the time domain, as illustrated in FIG. 2. Similarly to the traditional frequency domain adaptive filter approach of FIG. 1B, where the transform of the signals e(n) and u(n) would introduce a necessary and unavoidable frame delay due to the buffering of the signals, this frame delay would also affect the adaptive algorithm and the inverse transform.

However, differently to the traditional frequency domain adaptive filter approach of FIG. 1B, the cancellation signal v'(n) is created in the time domain, as the result of the reference signal u(n) filtered through the time-varying cancellation filter $\underline{h}'(n)$.

It is very important to note, that although a frame delay is involved in the estimation of the cancellation filter $\underline{h}'(n)$, which can also affect the adaptive filter performance if this frame delay becomes too big, the creation of v'(n) does not require a frame delay as required by the traditional frequency domain adaptive filter approach.

Hence, there is no need to have any additional delay between x(n) and u(n) for the cancellation purpose, hereby the name of delayless structure.

The method proposed in [1] was later refined in [2] to obtain better performance, however, we discovered that even the refined method in [2] can be improved further, using the method described in the present invention disclosure.

The existing delayless structure from [1] and [2] transform the signals e(n) and u(n), using uniform DFT filter banks (cf. blocks denoted 'Transform' in FIG. 2), into sub-band signals E(m,k) and U(m,k), where m and k are frequency domain time and frequency indices, respectively. In each frequency sub-band, adaptive coefficients are computed by the complex adaptive algorithm, e.g. an LMS algorithm (cf. block 'Adaptive Algorithm' in FIG. 2). The adaptive coefficients from all sub-bands are then transformed into the frequency domain, using the so-called frequency stacking technique, before the final inverse transform to obtain the time domain wideband filter coefficient (cf. 'Adaptive Algorithm & Inverse Transform' in FIG. 2).

The frequency stacking in [1], also referred to as the FFT stacking, has been shown to have an undesired property. Hence, a new frequency stacking method, referred to as the FFT-2, was proposed in [2]. However, even with the FFT-2 stacking, the performance can be further improved by using our proposed delayless structure.

Figure 3A:
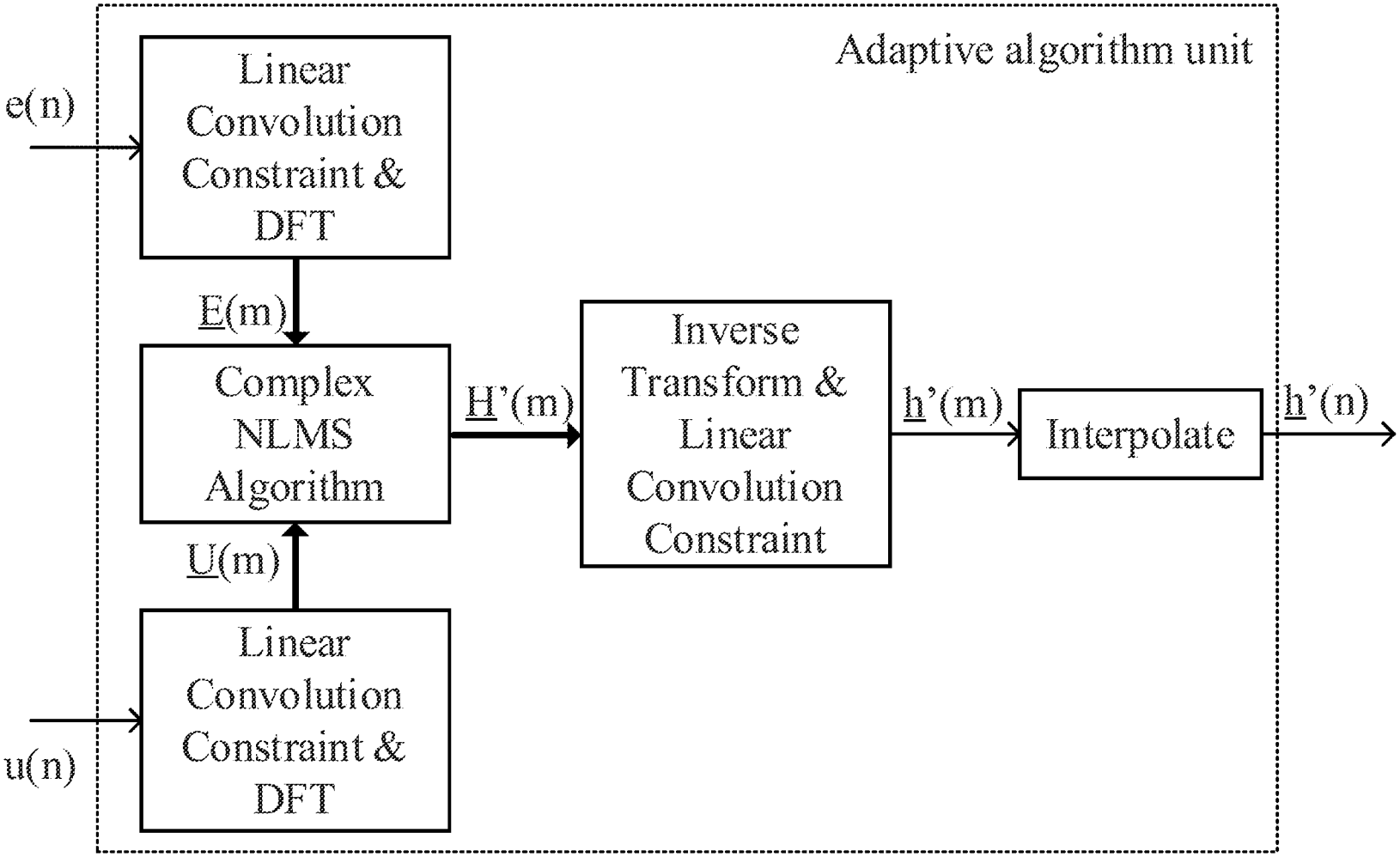
FIG. 3A shows an exemplary adaptive algorithm part of a delayless structure of an adaptive feedback cancellation setup according to the present disclosure.
Figure 3B:
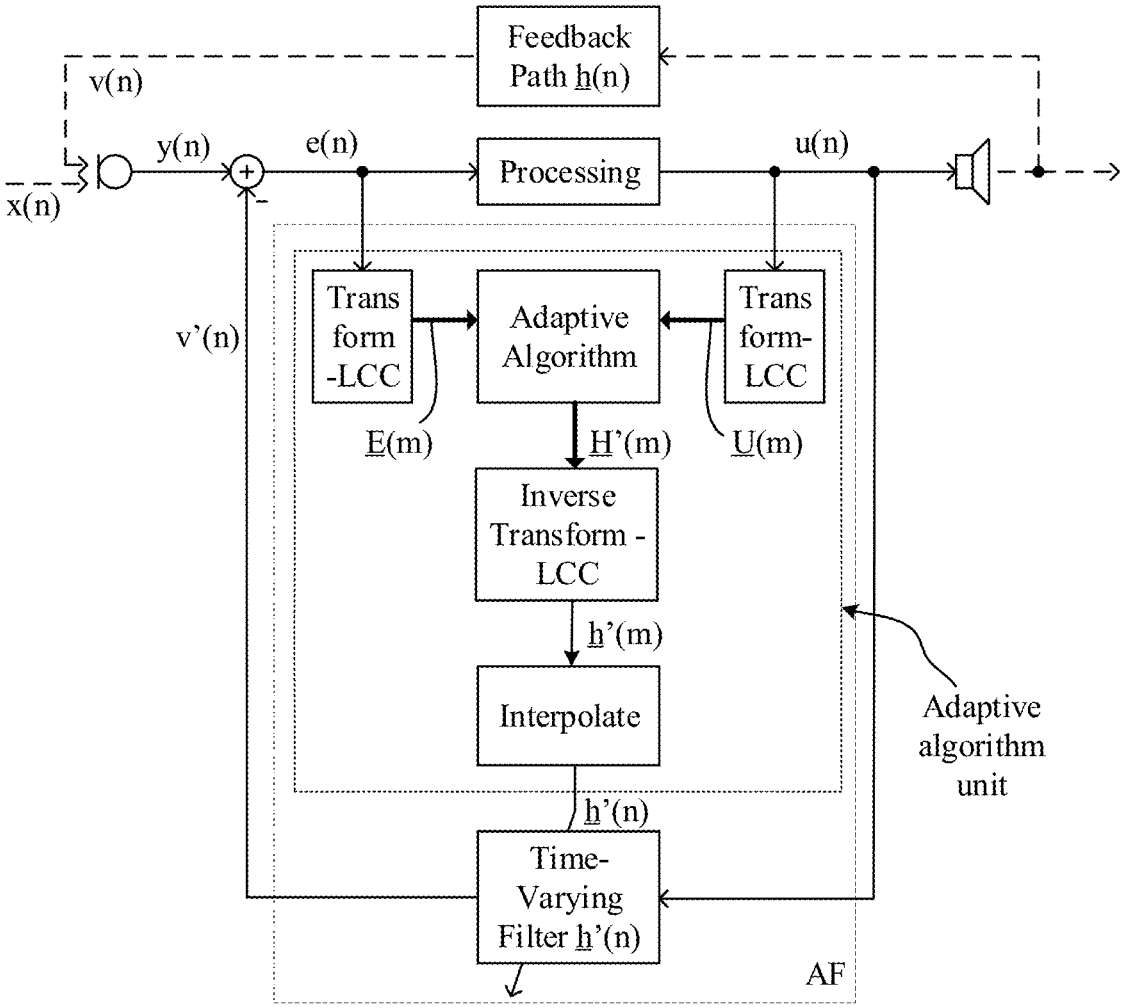
FIG. 3B shows a hearing device comprising an exemplary delayless structure of an adaptive feedback cancellation setup according to the present disclosure.

A difference between the structure of a delayless adaptive filter according to the present disclosure and the one depicted in FIG. 2 lies in the blocks 'Linear Convolution Constraint & DFT' in FIG. 3A, 3B. The 'Linear Convolution Constraint & DFT'-blocks, which replace the uniform DFT filter banks, sub-band FFTs, and the frequency stacking from the original delayless system in [1] and [2].

The linear convolution constraints and DFT blocks may e.g. use known techniques from signal processing, e.g. the overlap-save technique (cf. e.g. the 'Overlap-save_method'-entry of Wikipedia), or the overlap-add technique (cf. e.g. the 'Overlap-add_method'-entry of Wikipedia). The overlap-save and overlap-add method are also described in the textbook [4]. Thereby it is ensured that the subsequent frequency domain FFT algorithm provides a resulting time domain filter $\underline{h}'(n)$ to perform the desired linear convolution. Another advantage is that the structure is simpler, and easier to implement.

The processing of the forward path in FIG. 2 may be in the time domain (cf. block 'Processing'). The processing may, however, be in a transformed domain (e.g. the frequency domain). In other words, in the embodiment of FIG. 2, the input/output signals (y(n) and u(n), respectively) are time domain signals, but within the block (Processing) one can still conduct the processing in other transformed domains, e.g. in frequency domain. How the forward path block (Processing) is processed is independent to the delayless adaptive filter, both in the original system in [1] and [2], and in the proposed amended version.

FIG. 3A shows an exemplary adaptive algorithm unit of a delayless structure of an adaptive feedback cancellation setup according to the present disclosure. The proposed delayless adaptive filter structure transforms the signals e(n) and u(n) directly into the frequency domain (cf. blocks 'Linear Convolution Constraint & DFT' in FIG. 3A). The frequency domain signal vectors $\underline{E}(m)$ and $\underline{U}(m)$ in FIG. 3 are fed to the 'Complex NLMS algorithm' block performing the adaptive coefficient update (providing complex filter coefficients $\underline{H}'(m)$, before being inverse transformed back to the time domain (by block 'Inverse Transform & Linear Convolution Constraint' in FIG. 3A) and providing signal $\underline{h}'(m)$ (m being the time index corresponding to the decimated rate of the DFTs).

In this way, the cumbersome frequency stacking technique, as proposed in [1] and [2], is dispensed with. Further, the performance of the delayless adaptive filter according to the present disclosure is improved.

The delayless adaptive filter structure of FIG. 3A further comprises an interpolation unit ('Interpol' in FIG. 3A), e.g. implemented as a 'Sample & Hold' function to transform h'(m) to h'(n), where n is a time index with a finer resolution than m, where n e.g. corresponds to or being a (less) decimated version of the time sample index (e.g. of the AD-converter of the audio input signal).

If the decimation factor is D, then the corresponding index "n=D*m", i.e., and h'(m) is (only) updated for every D'th value of the "n" index. The purpose of the interpolation unit is to fill the gaps in the estimate h'(m), e.g. between h'(m) and h'(m+1) to thereby provide values at h(n=m), h(n=m+1), . . . h(n=m+D−1, h(n=m+D).

By sample & hold, we update h'(n) values, either with the updated h'(m) values for every D'th "n" indices (thereby sample), or using the previous h'(m) value (thereby "hold") for the "n" indices without a corresponding h'(m). By more advanced interpolation techniques, more realistic intermediate values may be provided. Alternatively, a low-pass filter may be applied to the values of h'(n) if provided by a sample and hold function to thereby smooth the signal.

In the following, calculations of an embodiment of the delayless adaptive filter according to the present disclosure are outlined.

First, we define the (2L×1) signal vectors $\underline{e}(m)$ and $\underline{u}(m)$, where m=1, 2, . . . is the frame index, to be:

$$\underline{e}(m)=[\underline{0}_L^T, e(m\cdot D-L+1), e(m\cdot D-L+2), \ldots, e(m\cdot D)]^T,$$

$$\underline{u}(m)=[u(m\cdot D-2L+1), u(m\cdot D-2L+2), \ldots, u(m\cdot D)]^T,$$

where $\underline{0}_L$ is a (L×1) null-vector containing L zeros, D is the decimation factor (so m·D means m multiplied by D), L is the length of (number of coefficients or weights controlling) the adaptive filter $\underline{h}'(n)$, and the superscript T denotes the vector transpose. The elements of the (2L×1) signal vectors represent time domain samples of the input signals e and u to the adaptive algorithm. The extra time samples in the input signals e and u represent an example of the linear convolution constraint. In general, the number of extra samples should be equal to or above a threshold number large enough to avoid circular convolution. The signal vectors may comprise more than 2L values, e.g. N·L, where N is an integer larger than 1.

The frequency domain signal vectors $\underline{E}(m)$ and $\underline{U}(m)$ are computed as, $$\underline{E}(m)=\mathrm{DFT}(\underline{e}(m)),$$

$$\underline{U}(m)=\mathrm{DFT}(\underline{u}(m)),$$

where DFT denotes the Discrete Fourier Transform. $\underline{E}(m)$ and $\underline{U}(m)$ are now the frequency transform of the time domain signal vectors $\underline{e}(m)$ and $\underline{u}(m)$. The $\underline{e}(m)$ and $\underline{u}(m)$ vectors are applied as the linear convolution constraint to avoid circular convolution.

The linear convolution constraint using the overlap-save technique is provided by the vector definition of $\underline{e}(m)$ and $\underline{u}(m)$. In particular, the L zeros added to the first part of $\underline{e}(m)$, and the first L old samples to create $\underline{u}(m)$. The linear convolution constraint may e.g. be implemented using the overlap-save technique or the overlap-add technique.

In this way, the length of 'concatenated vectors' and hence the DFT size is 2L, double of the adaptive filter length of $\underline{h}'(n)$. Each of the frequency domain signal vectors $\underline{E}(m)$ and $\underline{U}(m)$ represents a specific frequency band (in other words, the band index k has been omitted for simplicity).

The complex NLMS algorithm may then be carried out as, $$H'(m) = H'(m-1) + \frac{\mu \underline{U}^*(m) \odot \underline{E}(m)}{\|\underline{U}(m)\| + c}$$

where the superscript * denotes the complex conjugate, ⊙ denotes vector elementwise multiplication, $\|\underline{U}(m)\|$ denotes the Euclidean norm of the vector $\underline{U}(m)$, and c is a small positive number as a regularization parameter. $\underline{H}'(m)$ is hence a 2L×1 vector.

In other words, the complex LMS (or NLMS) update may make use of the unconstrained gradient in terms of $\underline{U}^*(m) \odot \underline{E}(m)$ in the above update equation, where $\underline{U}(m)$ and $\underline{E}(m)$ are defined as the frequency domain signal vectors, cf. above.

The inverse transform and the linear convolution constraint on $\underline{H}'(m)$ is performed as, $$\underline{h}'(m)=K(\mathrm{IDFT}(\underline{H}'(m)),L),$$

where IDFT denotes the Inverse Discrete Fourier Transform, and the function $K(\underline{x}, L)$ keeps the first L samples of the vector $\underline{x}$ and discards the remaining (L) samples. $\underline{h}'(m)$ is thus a L×1 vector. Removing the last L samples, to reach $\underline{h}'(m)$, is also part of the linear convolution constraint.

The adaptive filter coefficient update of $\underline{h}'(m)$ occurs at the rate of the frequency domain processing, and finally an interpolation function, e.g. a sample and hold function, is used to bring $\underline{h}'(m)$ to $\underline{h}'(n)$, where m and n are tied together by a decimation factor.

The adaptive algorithm unit of FIG. 3A is shown in the context of a feedback cancellation system of a hearing device, e.g. a hearing aid, in FIG. 3B. FIG. 3B shows a hearing device comprising an exemplary delayless structure of an adaptive feedback cancellation setup according to the present disclosure. The embodiment of FIG. 3B is equivalent to the embodiments of FIGS. 1A, 1B, and 2 but comprises a different implementation of the adaptive filter (AF) as described in connection with FIG. 3A.

FIG. 3B schematically illustrates a block diagram of a hearing device, e.g. a hearing aid, or a part thereof. The hearing device may be adapted to be worn by a user, or for being partially implanted in the head of the user (e.g. in connection with a bone conducting style hearing aid). The hearing device comprises a forward path for processing an audio signal. The acoustic input signal comprises a mixture of a feedback signal (v(n) from an output transducer of the hearing device and a signal (x(n), where n is time index, e.g. a time-sample index) from the environment. The forward path comprises at least one input transducer (here a microphone) for converting a sound to corresponding at least one electric input signal (y(n)) representing the sound. The at least one input transducer may comprise appropriate analogue to digital conversion circuitry to provide the electric input signal as a digitized signal (e.g. comprising stream of digital samples of the electric input signal). The at least one input transducer may comprise a MEMS-microphone. The forward path further comprises a hearing aid processor (Processing) for providing a processed signal (u(n)) in dependence of the at least one electric input signal (y(n)), or (as here) of a signal originating there from (feedback corrected signal e(n)). The processed signal may e.g. be provided in dependence of a user's hearing ability, e.g. aimed at compensating for a hearing impairment. The processor may comprise one or more filter banks to allow processing to be performed in the frequency domain (where frequency sub-band signals may be processed individually). The forward path further comprises an output transducer (here a loudspeaker) for providing stimuli perceivable as sound to the user in dependence of said processed signal. The output transducer may comprise digital to analogue conversion circuitry, e.g. depending on the practical solution. The hearing device further comprises a feedback control system for controlling, e.g. estimating and fully or partially compensating for, the feedback signal (v(n)) from the output transducer to the input transducer of the hearing device. The feedback control system comprises an adaptive filter (AF) and a combination unit ('+') located in the forward path. The adaptive filter (AF) comprises an adaptive algorithm unit (Adaptive algorithm unit) and a time domain time varying filter (Time Varying Filter $\underline{h}'(n)$). The adaptive algorithm unit is configured to provide a filter control signal (denoted $\underline{h}'(n)$ in FIG. 3B) for adaptively controlling filter coefficients of the time varying filter in dependence of different first and second algorithm input signals (e(n), u(n)) of the forward path. The adaptive algorithm unit comprises first and second transform units (Transform-LCC) for transforming the different first and second algorithm input signals (e(n), u(n)) to respective first and second transform domain algorithm input signals ($\underline{E}(m)$, $\underline{U}(m)$), where m is a decimated time index, e.g. a time frame index). The adaptive algorithm unit further comprises an adaptive algorithm (Adaptive Algorithm) configured to provide an estimate ($\underline{H}'(m)$) in the transform domain of a current feedback path from the output transducer to the input transducer in dependence of the first and second transform domain algorithm input signals ($\underline{E}(m)$, $\underline{U}(m)$). The adaptive algorithm unit further comprises an inverse transform unit (Inverse Transform-LCC) configured to convert the estimate of the current feedback path ($\underline{H}'(m)$) in the transform domain to an estimate of the current feedback path in the time domain ($\underline{h}'(m)$). The adaptive algorithm unit is further configured to provide the filter control signal in dependence of the estimate of the current feedback path in the time domain ($\underline{h}'(m)$). The time domain time varying filter (Time Varying Filter $\underline{h}'(n)$) is configured to use adaptive filter coefficients controlled in dependence of the filter control signal to provide an estimate of an impulse response of the current feedback path ($\underline{h}'(n)$) to thereby provide an estimate (v'(n)) of the current feedback signal (v(n)) in dependence of the (current) processed signal (u(n)). The combination unit ('+') located in the forward path is configured to subtract the estimate of the current feedback signal (v'(n)) from a signal (y(n)) of the forward path (here the electric input signal from the microphone) to provide the feedback corrected signal (e(n)). The first and second transform units and said inverse transform unit comprise respective linear convolution constraints, e.g. as discussed above in connection with FIG. 3A.

The first and second transform units (Transform-LCC) and the inverse transform unit (Inverse Transform-LCC) comprise respective linear convolution constraints to ensure that the frequency domain algorithm provides a resulting time domain filter $\underline{h}'(n)$ to perform the desired linear convolution. The linear convolution constraints may be mutually different. Each of the first and second transform units are configured to apply the linear convolution constraint to the first and second algorithm input signals (e(n), u(n)). The transform units may be configured to apply a Fourier transform algorithm to the respective linearly constrained signals to thereby provide the first and second algorithm input signals ($\underline{E}(m)$, $\underline{U}(m)$) in the frequency domain. The Fourier transform algorithm may comprise a Discrete Fourier Transform (DFT) algorithm, e.g. a Short Time Fourier Transform (STFT) algorithm.

The filter control signal may be equal to the estimate of the current feedback path in the time domain ($\underline{h}'((m))$). The adaptive algorithm unit may (as here) comprise an interpolation function (Interpol) for providing values of the filter control signal corresponding to a sample index (n), e.g. to fill the gaps in values between a time frame index (m) and a time sample index (n). The filter control signal may be equal to the estimate of the current feedback path in the time domain ($\underline{h}'(n)$). The filter control signal may comprise update filter coefficients (or updates to filter coefficients) for use in the time varying filter providing the estimate of the current feedback path in the time domain ($\underline{h}'$).

A comparison of the traditional methods (cf. [2]) and the proposed method using Matlab simulations has been made. In a closed loop acoustic feedback cancellation setup for the hearing aid application, initially we have a feedback path in free field, then after 1 s we change the feedback path with a phone next to the ear. The results in terms of misalignment $\|\underline{h}_{true}(n)-\underline{h}'(n)\|$ is shown in FIG. 4.

Figure 4:
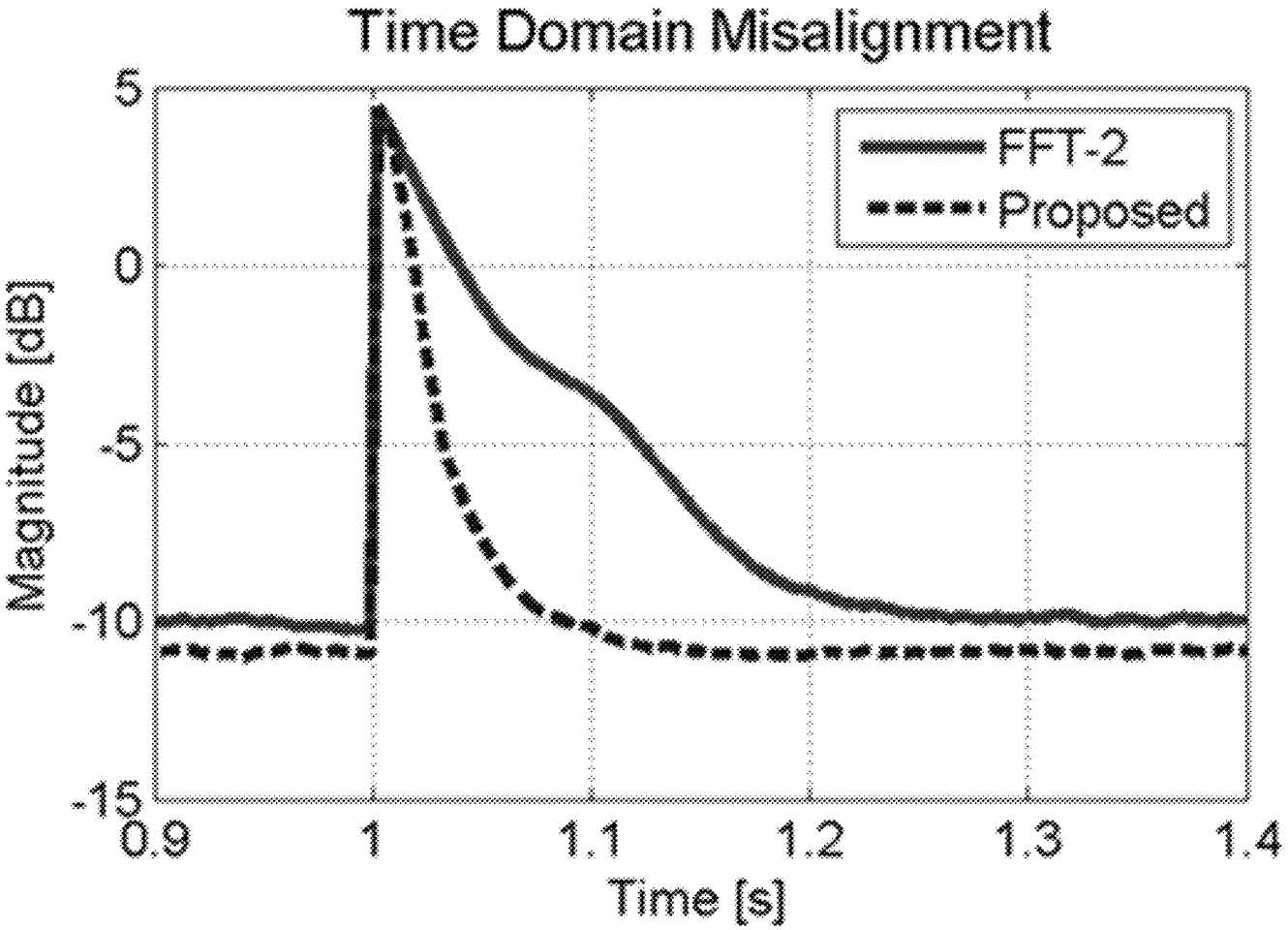
FIG. 4 shows simulation results in terms of misalignment for the delayless structure using FFT-2 stacking [2], and the proposed delayless structure of the present disclosure, The figures are schematic and simplified for clarity, and they just show details which are essential to the understanding of the disclosure, while other details are left out. Throughout, the same reference signs are used for identical or corresponding parts.

FIG. 4 shows simulation results in terms of misalignment for the delayless structure using FFT-2 stacking [2], and the proposed delayless structure of the present disclosure. From FIG. 4 it can be observed that the adaptive filter $\underline{h}'(n)$ using the delayless structure of the present disclosure has faster convergence as well as lower steady-state error, compared to the delayless structure using the FFT-2 stacking.

Embodiments of the disclosure may e.g. be useful in applications such as hearing aids or headsets or audio processing devices, where acoustic feedback may be a problem.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

REFERENCES

[1] D. R. Morgan and J. C. Thi, "A delayless subband adaptive filter architecture," IEEE Trans. Signal Process., vol. 43, no. 8, pp. 1819-1830, August 1995

[2] J. Huo, S. Nordholm, and Z. Zang, "New weight transform schemes for delayless subband adaptive filtering," in Proc. IEEE Global Telecommunications Conf, vol. 1, November 2001, pp. 197-201.

[3] U.S. Pat. No. 5,329,587A (AT&T) 12.07.1994.

[4] A. V. Oppenheim and R. W. Schafer, Discrete-Time Signal Processing, Englewood Cliffs, N.J., US: Prentice-Hall, March 1989.

The invention claimed is:

1. A hearing device adapted to be worn by a user, or for being partially implanted in the head of the user, comprising a forward path for processing an audio signal, the forward path comprising at least one input transducer for converting a sound to a corresponding at least one electric input signal representing said sound, a hearing aid processor for providing a processed signal in dependence of said at least one electric input signal, or a signal originating there from, and an output transducer for providing stimuli perceivable as sound to the user in dependence of said processed signal, a feedback control system comprising an adaptive filter, and a combination unit, the adaptive filter comprising an adaptive algorithm unit, and a time domain time varying filter, wherein the adaptive algorithm unit is configured to provide a filter control signal for adaptively controlling filter coefficients of the time varying filter in dependence of different first and second algorithm input signals of the forward path, the adaptive algorithm unit comprising first and second transform units for transforming said different first and second algorithm input signals to respective first and second transform domain algorithm input signals, the adaptive algorithm being configured to provide an estimate ($\underline{H}'$) in the transform domain of a current feedback path from the output transducer to the input transducer in dependence of said first and second transform domain algorithm input signals, wherein the adaptive algorithm is updated based on an unconstrained gradient determined from said first and second transform domain algorithm input signals $\underline{E}$, $\underline{U}$ as $\underline{U}^*\odot\underline{E}$, where * denotes the complex conjugate, and denotes vector elementwise multiplication, and an inverse transform unit configured to convert the estimate of the current feedback path in the transform domain to an estimate of the current feedback path in the time domain, and wherein said filter control signal is provided in dependence of said estimate of the current feedback path in the time domain, and wherein the time domain time varying filter is configured to use adaptive filter coefficients controlled in dependence of said filter control signal to provide an estimate of an impulse response of the current feedback path to thereby provide an estimate of a current feedback signal in dependence of the processed signal, and the combination unit being located in the forward path and configured to subtract said estimate of the current feedback signal from a signal of the forward path to provide a feedback corrected signal, and wherein said first and second transform units and said inverse transform unit comprise respective linear convolution constraints.

2. A hearing device according to claim 1 wherein the linear convolution constraint is applied to respective first and second algorithm input signal vectors, each comprising a present value and a number of previous values of the respective first and second algorithm input signals.

3. A hearing device according to claim 2 wherein the number of previous values of the respective first and second algorithm input signals is larger than or equal to L−1, where L is the number of coefficients or weights controlling the adaptive filter.

4. A hearing device according to claim 1 wherein the respective first and/or second algorithm input signal vectors contain a number of added time sample values.

5. A hearing device according to claim 1 wherein the linear convolution constraint is further applied to respective transformed first and second algorithm input signal vectors, each comprising a present value and a number of previous values of the respective first and second algorithm input signals, and/or a number of added time sample values.

6. A hearing device according to claim 1 wherein the linear convolution constraint is applied to the output from the inverse transform.

7. A hearing device according to claim 1 wherein the linear convolution constraint is implemented by using the overlap-save, and/or overlap-add techniques.

8. A hearing device according to claim 1 wherein the linear convolution constraint of the first and second transform units are different.

9. A hearing device according to claim 1 wherein the first algorithm input signal comprises the feedback corrected signal, and wherein the second algorithm input signal comprises the processed signal.

10. A hearing device according to claim 1 wherein the transform is executed at a decimated rate D.

11. A hearing device according to claim 1 wherein an interpolation function, is used to get the time variant filter to work at a higher sampling rate.

12. A hearing device according to claim 1 wherein said first and second transform units are configured to determine (2L×1) dimensional time-domain signal vectors e(m) and u(m), respectively, where m=1, 2, . . . is a frame index:

$$\underline{e}(m)=[\underline{0}_L^T, e(m\cdot D-L+1), e(m\cdot D-L+2), \ldots, e(m\cdot D)]^T,$$

$$\underline{u}(m)=[u(m\cdot D-2L+1), u(m\cdot D-2L+2), \ldots, u(m\cdot D)]^T,$$

where $0_L$ is a (L×1) dimensional null-vector containing L zeros, D is a decimation factor, m·D meaning m multiplied by D, L is the number of coefficients or weights controlling the adaptive filter $\underline{h}'(n)$, and the superscript $^T$ denotes the vector transpose, and where the elements of the (2L×1) dimensional signal vectors (e(m), u(m)) represent time domain samples of the input signals (e(n)) and (u(n)) to the adaptive algorithm, and wherein the extra L time samples in the input signals e(m) and u(m) represent linear convolution constraint.

13. A hearing device according to claim 12 wherein the signal vectors e(m) and u(m) are applied as the linear convolution constraint to avoid circular convolution.

14. A hearing device according to claim 12 wherein respective transform domain signal vectors E(m) and U(m) are computed as, $$\underline{E}(m)=\mathrm{TDA}(\underline{e}(m)),$$

$$\underline{U}(m)=\mathrm{TDA}(\underline{u}(m)),$$

where TDA is a Transform Domain Algorithm.

15. A hearing device according to claim 12, wherein said transform domain is the frequency domain, the adaptive algorithm comprises a complex Least Mean Square (LMS) or a complex Normalized Least Mean Square (NLMS) algorithm, and the complex LMS or NLMS algorithm is updated based on an unconstrained gradient determined in terms of $\underline{U}^*(m)\odot\underline{E}(m)$, where $\underline{U}(m)$ and $\underline{E}(m)$ are defined as the following frequency domain signal vectors:

$$\underline{E}(m)=\mathrm{DFT}(\underline{e}(m)), \text{ and}$$

$$\underline{U}(m)=\mathrm{DFT}(\underline{u}(m)),$$

wherein DFT is a Discrete Fourier Transform algorithm.

16. A hearing device according to claim 1 wherein said transform domain is the frequency domain.

17. A hearing device according to claim 1 wherein the adaptive algorithm comprises a complex Least Mean Square or a complex Normalized Least Mean Square algorithm.

18. A hearing device according to claim 1 being constituted by or comprising an air-conduction type hearing aid, a bone-conduction type hearing aid, a cochlear implant type hearing aid, or a combination thereof.

19. A method of operating a hearing device adapted to be worn by a user, or for being partially implanted in the head of the user, the hearing device comprising a forward path for processing an audio signal comprising at least one input transducer for converting a sound to corresponding at least one electric input signal representing said sound, a hearing aid processor for providing a processed signal in dependence of said at least one electric input signal, and an output transducer for providing stimuli perceivable as sound to the user in dependence of said processed signal, and a feedback control system comprising an adaptive filter comprising an adaptive algorithm and a time domain time varying filter, the method comprising transforming different first and second algorithm input signals of the forward path to respective first and second transform domain algorithm input signals, configuring the adaptive algorithm to provide an estimate in the transform domain of a current feedback path from the output transducer to the input transducer in dependence of said first and second transform domain algorithm input signals, wherein the adaptive algorithm is updated based on an unconstrained gradient determined from said first and second transform domain algorithm input signals $\underline{E}$, $\underline{U}$ as $\underline{U}^*\odot\underline{E}$, where * denotes the complex conjugate, and ⊙ denotes vector element-wise multiplication, inversely transforming said estimate of the current feedback path in the transform domain to an estimate of the current feedback path in the time domain, providing a filter control signal in dependence of said estimate of the current feedback path in the time domain, adaptively controlling filter coefficients of the time varying filter in dependence of said filter control signal to thereby provide an estimate of a current feedback signal from said output transducer to said input transducer in dependence of the processed signal, and subtracting said estimate of the current feedback signal from a signal of the forward path to provide a feedback corrected signal, and, wherein said transforming and said inversely transforming procedures comprise respective linear convolution constraints.

20. A non-transitory computer readable medium storing a computer program comprising instructions which, when the program is executed by a computer, cause the computer to carry out the method of claim 19.

* * * * *